US005472166A

United States Patent [19]

Wear

[11] Patent Number: 5,472,166

[45] Date of Patent: Dec. 5, 1995

[54] VARIOUSLY ANGLED SIGN POLE MOUNT

[75] Inventor: Philip A. Wear, Minnetonka, Minn.

[73] Assignee: Popco, Inc., Minneapolis, Minn.

[21] Appl. No.: 220,672

[22] Filed: Mar. 31, 1994

[51] Int. Cl.[6] ..... F16M 13/00

[52] U.S. Cl. ..... 248/514; 248/535; 248/536; 116/173

[58] Field of Search ..... 248/514–515, 248/518, 534, 535–536, 538, 539, 223.4, 225.1, 207, 558; 116/173, 174, 175

[56] References Cited

U.S. PATENT DOCUMENTS

| | | | |
|---|---|---|---|
| 1,632,726 | 6/1927 | Conklin | 248/538 |
| 2,794,414 | 6/1957 | Reifschneider | 116/173 |
| 4,593,877 | 6/1986 | van der Wyk | 248/535 X |
| 4,865,287 | 9/1989 | Stoudt | 116/173 X |
| 5,156,110 | 10/1992 | Fuller | 116/173 |
| 5,207,406 | 5/1993 | Stine et al. | 248/514 |

*Primary Examiner*—Ramon O. Ramirez
*Assistant Examiner*—Korie Chan
*Attorney, Agent, or Firm*—Leo Gregory

[57] ABSTRACT

A sign pole mount having a curved face with a vertical passage and an angled passage therein opening through said face, the mount having a vertical backing wall and a bottom backing wall, each having inward extending grooves along the sides thereof and a base plate having angled projections adapted to respectively receive the grooves in alternate positions for various angled extensions of a sign pole inserted through the passages of the mount. The base plate can be secured either to a vertical or horizontal supporting surface.

9 Claims, 3 Drawing Sheets

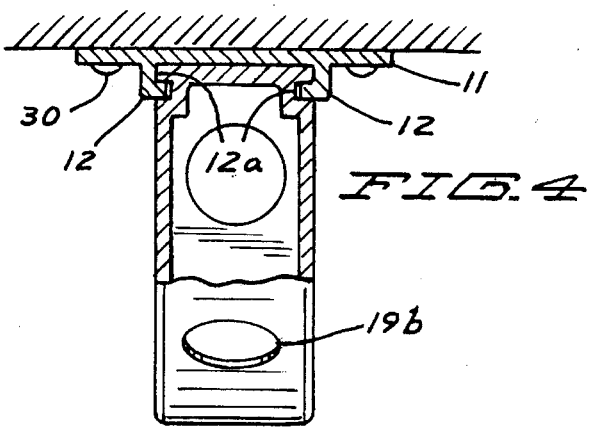
FIG. 4
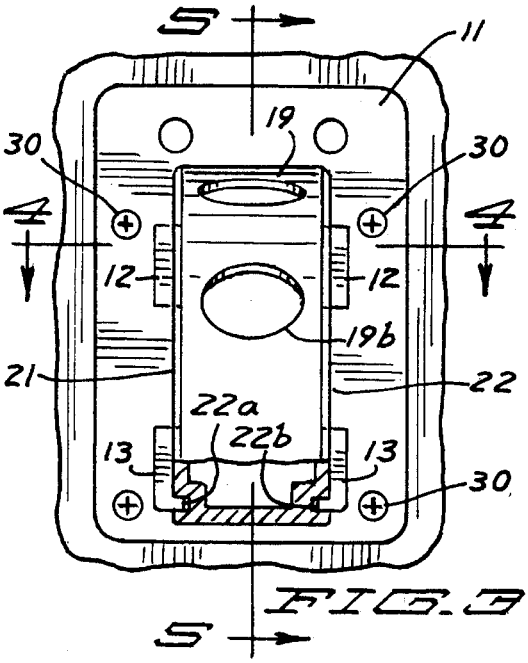
FIG. 3
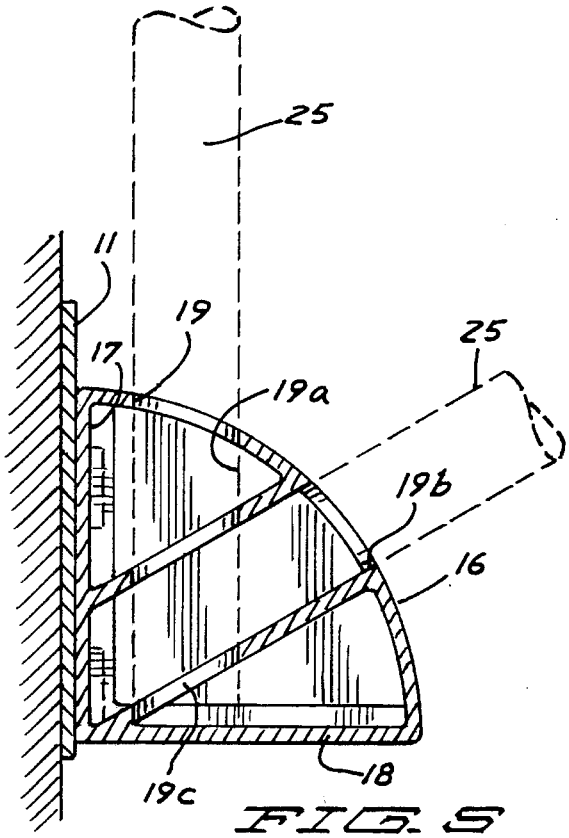
FIG. 5
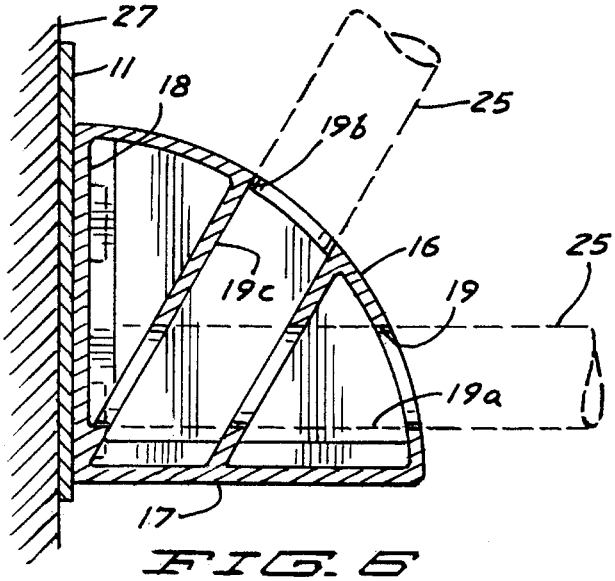
FIG. 6
FIG. 7
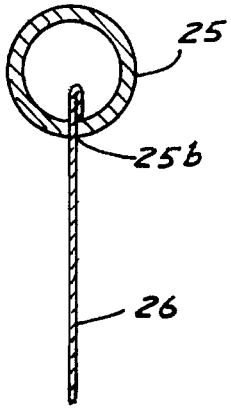

VARIOUSLY ANGLED SIGN POLE MOUNT

BACKGROUND OF THE INVENTION

1. Field of Invention

Relates to a mounting bracket for various angled extensions of a sign pole.

2. Description of the Previous Art

Poles are not uncommon in use for hanging signs however it appears that pole mounting brackets are adapted to hang or extend poles only horizontally or at a single angle.

However more recently there has appeared a sign pole mount for various angled extensions of a sign pole wherein a base plate thereof may be mounted on a horizontal or vertical surface to position the sign pole mount to provide for various angled extensions of a sign pole.

SUMMARY OF THE INVENTION

It is an object of this invention to provide a device for mounting a sign pole adaptable to extend the pole in a plurality of different angled positions.

It is another object of this invention to provide a base plate to position a sign pole mount for the extension of a sign pole, the sign mount being adapted to be positioned to extend the sign pole to be in various angled positions.

It is a further object of this invention to provide a base plate to hold in more than one position a mounting member for a sign pole, said base plate and mounting member being adapted to have interconnecting positions to provide a plurality of different positions for the angled extension of a sign pole.

These and other objects and advantages will be set forth in the following description made in connection with the accompanying drawings in which like reference characters refer to similar parts throughout the several views.

BRIEF DESCRIPTION OF THE DRAWINGS

FIG. 3 is a front plan view of a base plate mounted on a vertical surface taken on line 3—3 of FIG. 1 showing a sign pole mount therein with a portion broken away and showing an alternate position thereof in dotted line;

FIG. 4 is a view of the structure of FIG. 3 partially in horizontal section taken on line 4—4 of FIG. 3 and partially in front elevation;

FIG. 5 is a view similar to that of FIG. 3 in side elevation showing in broken dotted line the extensions of sign poles in alternate angled directions;

FIG. 6 is a view similar to that of FIG. 5 except that the bottom wall of the sign pole mount of FIG. 5 is positioned to be a vertical back wall in FIG. 6;

FIG. 7 is a view in cross section taken on line 7—7 of FIG. 6;

DESCRIPTION OF A PREFERRED EMBODIMENT

Figure 1:
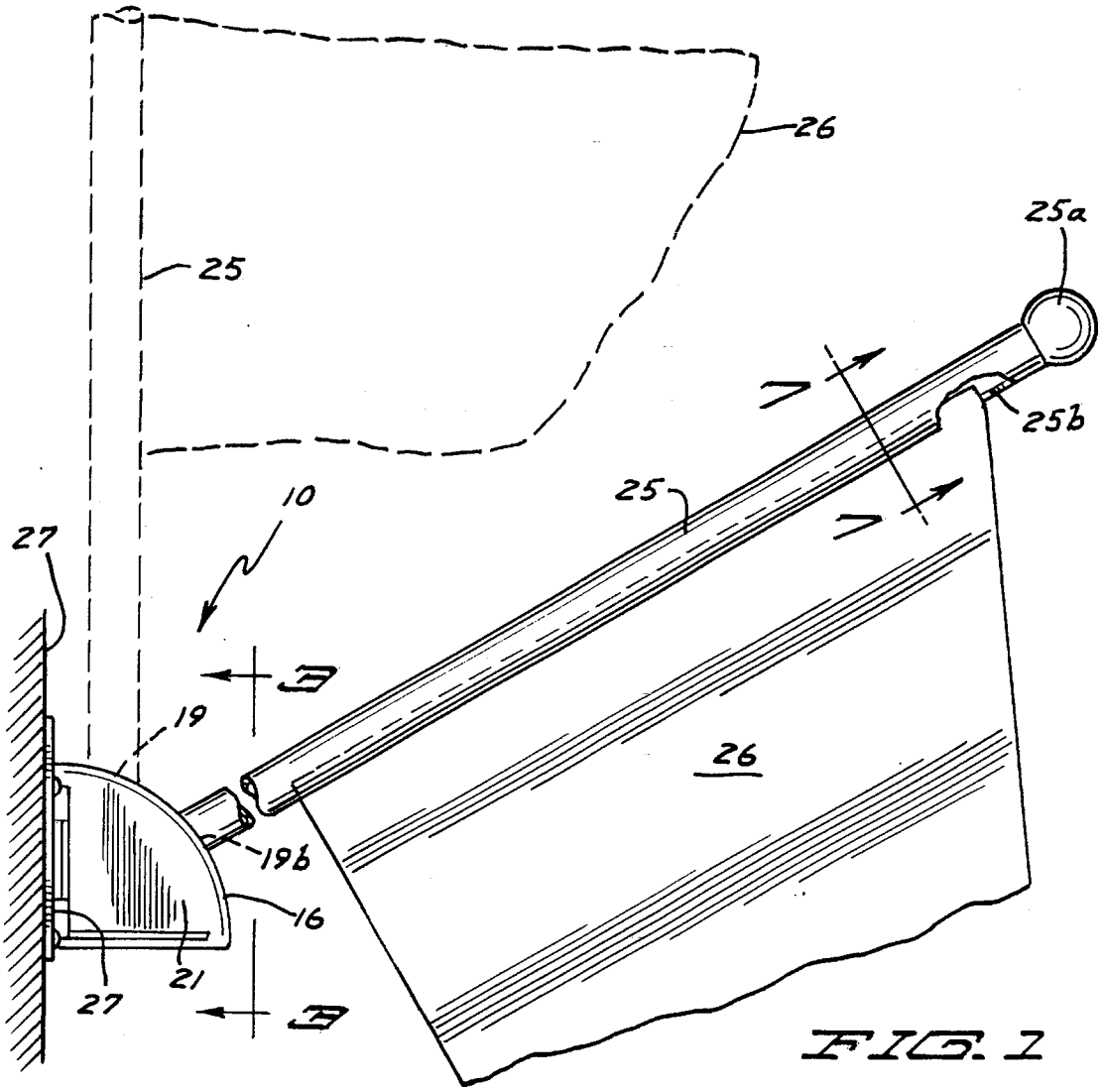
FIG. 1 is a side elevational view showing the device herein in one mounting position and in an alternate position in dotted line with a broken portion of a sign shown in front elevation.
Figure 2:
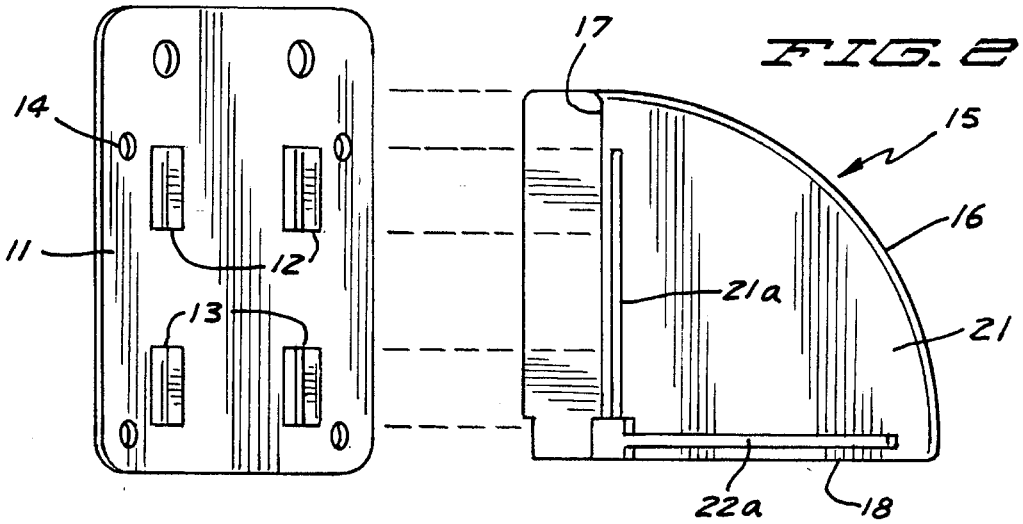
FIG. 2 is a view of a base plate in front elevation and a sign pole mount in side elevation.

Referring to the drawings and more particularly to FIG. 1, the invention herein is indicated generally by the reference numeral 10 and comprises a base plate 11, a sign pole mount or bracket 15 and a sign pole 25.

Said sign pole is a cylindrical staff formed of an appropriate plastic material having a ball shaped end cap 25*a* and said pole has a longitudinal narrow slot 25*b* the length thereof to frictionally hold a depending sign 26 having an edge portion disposed into and secured in said slot.

The base plate 11 is shown as a rectangular plate member having two pairs of elongated facing angled projections 12 and 13 forming pairs of facing horizontal slots represented by 12*a* as shown in FIG. 4. A plurality of holes 14 are formed about said base plate for the insertion of one or more screws 30 to secure the same to a supporting surface or the same may be secured by the use of a two sided adhesive tape.

Adapted to be mounted in more than one way onto said base plate, as will be described, is a sign pole bracket or mount 15. Said mount has a curved face 16 extending through 90° and having backing walls 17 and 18, the same being at right angles to one another.

Said curved face has a hole or opening 19 therein which is the outlet of a passage 19*a* which is vertically or horizontally disposed depending upon the positions of the backing walls. Said curved face has a second hole or opening 19*b* therein which is the outlet for a passage 19*c* within said mount which is angled at 60° or 30° depending upon the positions of the backing walls. This will be further described.

Said mount 15 has side walls 21 and 22. Said side walls 21 and 22 each have closely adjacent their respective backing walls 17 and 18 and parallel thereto elongated grooves represented by 21*a* and 21*b*. These grooves have their respective ends spaced apart providing openings as at 21*b* and 22*b* (FIG. 3) giving access to said grooves and permitting said grooves respectively to receive said projections 12 and 13 to become secured therein. Said grooves have closed ends opposite their open ends which are not here shown. Thus said backing wall 17 has adjacent each side thereof grooves 21*a* and 21*b* and said backing wall 18 has adjacent each side thereof grooves 22*a* and 22*b*, the groove 21*b* is not shown.

Said base plate 11 and said mount or bracket 15 are preferably molded of a polyethylene which is readily molded and which provides a very long lasting durable product and provides a good appearing long wearing surface.

The mount and base plate despite simplicity in structure are very versatile as to the number of different angular positions in which the sign pole may be extended therefrom.

First, (FIGS. 3 and 5) with the base plate 11 secured to a vertical holding or supporting surface 27 and the backing wall 17 upon the base plate and with the grooves 21*b* and 22*b* being disposed into the slots 12*a* and 13*a*, the opening 19 with its passage 19*a* will face upwardly in a 90° vertical direction and the opening 19*b* with its passage will extend the sign pole upwardly at an angle of 30° for two different angular positions of the sign pole outwardly of said openings of said mount. Said positions normally will be used as alternate positions.

Next, (FIG. 6) with the backing wall 18 mounted upon said base plate in a vertical position and the grooves 22*a* and 22*b* secured in said slots 12*a* and 13*a*, the opening 19 and its passage extend horizontally and the opening 19*b* and its passage are positioned to be facing upwardly at a 60° angle providing alternate third and fourth angular positions for the extension of said sign pole 25.

Figure 8:
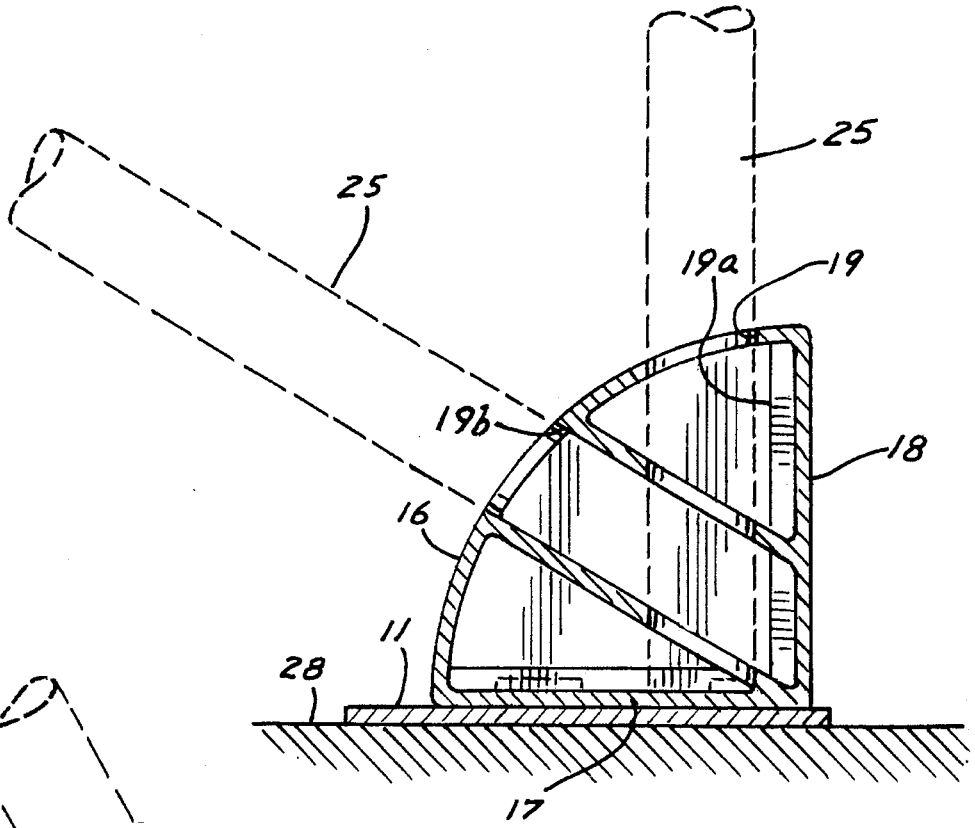
FIG. 8 is a side elevational view in section with the base plate thereof mounted on a horizontal surface.
Figure 9:
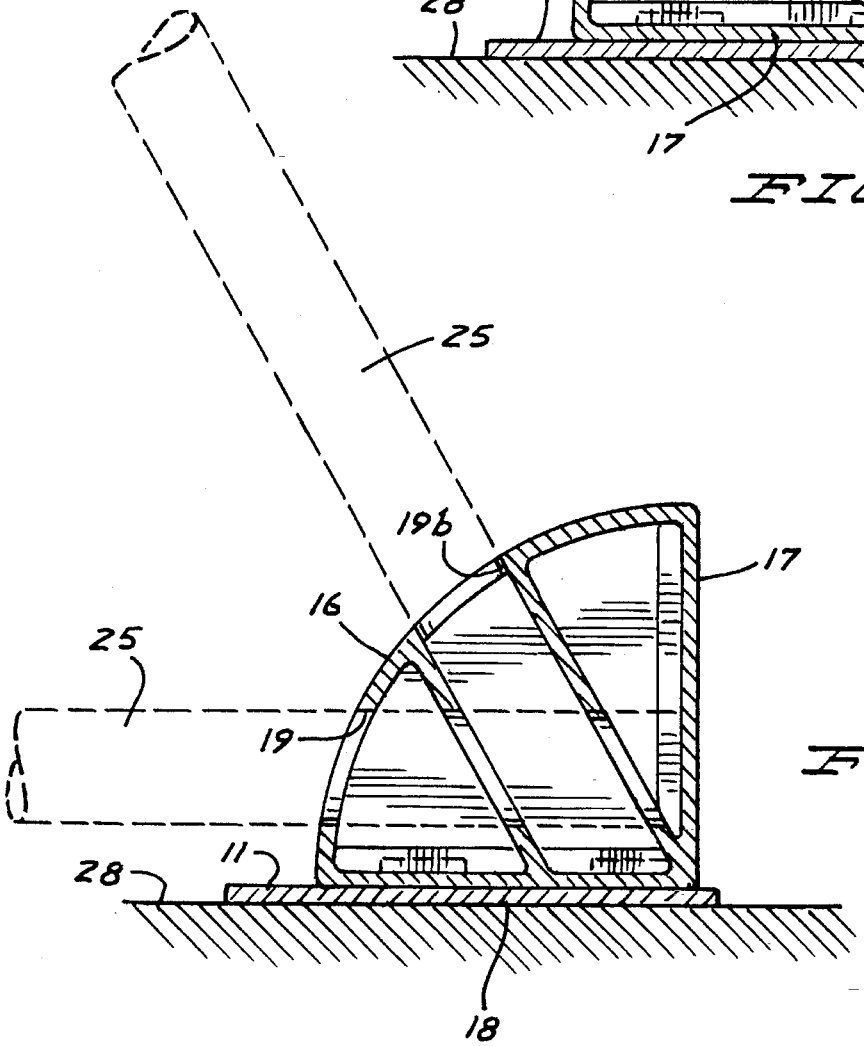
FIG. 9 is a view similar to that of FIG. 8 with the back vertical wall of the sign mount of FIG. 8 being the bottom horizontal wall of FIG. 9 and in each of these views alternate positions of a sign pole are shown in dotted line.

Referring to FIG. 8 with the base plate 11 secured to a horizontal surface 28 and the backing wall 17 being upon the base plate with the grooves 21*a* and 22*a* secured in the slots 12*a* and 13*a* as previously described, the opening 19 and its passage 19*a* serve to extend the sign pole 25 upwardly at a 90° angle and the opening 19*b* and its passage extend a sign pole outwardly vertically or at a 60° angle for a fifth and sixth alternate position.

With the base plate 11 secured to a horizontal surface and the backing wall 18 being disposed upon and secured to said base plate horizontally, the opening 19 and its passage extend the sign pole 25 horizontally and the opening 19*b* and its passage extend a sign pole outwardly at an angle of 60° for a seventh and eighth alternate positions of the extension of the sign pole 25.

Thus with the base plate and sign pole mount secured to a horizontal surface, a sign pole may be extended vertically, horizontally and at either a 30° or 60° angle and the same positions are present for use with the base plate and sign pole mount secured to a vertical surface providing eight different angular positions for the extension of a sign pole.

A pole sign indicating a particular event, such as a sale, or merely identifying a location is eye catching and is very effective in securing attention, if only for a short lived moment.

It will of course be understood that various changes may be made in the form, details, arrangement and proportions of the device herein without departing from the scope of the invention which, generally stated, consists in a device capable of carrying out the objects and purposes above set forth, in the parts and combination of parts disclosed and defined in the appended claims.

What is claimed is:

1. A device for holding a sign pole mount in variously angled extended positions, comprising a base plate, a sign pole mount, means for securing said mount to said base plate in selective alternate positions, said sign pole mount having a pair of angled backing walls, side walls extending from said angle backing walls, and a smooth connecting facing wall connecting said side wall, said mount having extending therethrough a pair of angularly spaced passages respectively having openings in said facing wall, said side walls each having grooves respectively adjacent each of said backing walls, said means releasably securing said mount in said alternative positions, means for attaching said base plate to a supporting surface such that said passages are angled outwardly, wherein said means for securing said mount to said plate permit the passages to be selectively position at different angular positions, and each of said passages are adapted to receive an end portion of said sign pole to have said pole extend outwardly thereof.

2. The structure of claim 1, wherein said first mentioned means comprises parallel spaced angular projections having underlying slots, and said grooves of said mount are adapted to engage said projections to be releasably secured thereby.

3. The structure of claim 1, wherein said base plate is mounted on said supporting surface which is horizontal, said mount having said grooves in the side walls thereof respectively adjacent the backing walls thereof, and said mount being adapted to have the grooves thereof engage said securing means of said base plate whereby one of the passages thereof is disposed to be vertical and the other to be disposed at certain other angular positions.

4. The structure of claim 1, wherein said base plate is mounted upon a vertical supporting surface, said mount is mounted upon said base plate having the grooves adjacent one of the backing walls engaging said securing means of said base plate such that one of said passages is vertically disposed and the other of said passages is angularly disposed on the order of 30°.

5. The structure of claim 1, wherein said baseplate is mounted upon a vertical surface, and said mount is mounted upon said base plate having the grooves adjacent one of the backing walls engaging said securing means of said base plate such that one of said passages is horizontally disposed and the other of said passages is angularly disposed on the order of 60°.

6. The structure of claim 1, wherein said base plate is mounted upon a horizontal surface, and said mount is mounted upon said base plate having the grooves adjacent one of the backing walls engaging said securing means of said base plate to have one of the passages vertically disposed and the other of the passages disposed at an angle on the order of 60°.

7. The structure of claim 1, wherein said base plate is mounted upon a horizontal surface, and said mount is mounted upon said base plate to have one of said passages horizontally disposed and the other of said passages being disposed at an angle on the order of 30°.

8. The structure of claim 1, wherein said base plate is mounted upon said supporting surface, and said mount is adapted to be mounted upon said base plate whereby in one position thereon one of said passages is vertically disposed with the other passage angularly disposed relative to said vertical passage, and in an alternate position therein, whereby said one of said passages is horizontally disposed and the other of said passages is angularly disposed relative to said horizontal passage.

9. The structure of claim 1, wherein said base plate is mounted upon said supporting surface, and said mount is adapted to be mounted upon said base plate whereby said passages are angularly disposed relative to one another in one position of said mount and are otherwise angularly disposed relative to one another with said mount being upon said base plate in an alternate position.

* * * * *